US006976717B2

(12) United States Patent
Barr et al.

(10) Patent No.: US 6,976,717 B2
(45) Date of Patent: Dec. 20, 2005

(54) VEHICLE DOOR HANDLE ASSEMBLY

(75) Inventors: Geoffrey Barr, Troy, MI (US); Fred L. Sawgle, Lapeer, MI (US); Matthew W. Lapinski, Waterford, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/360,048

(22) Filed: Feb. 6, 2003

(65) Prior Publication Data

US 2004/0155472 A1 Aug. 12, 2004

(51) Int. Cl.[7] ..... E05B 3/00
(52) U.S. Cl. ..... 292/336.3; 292/DIG. 64
(58) Field of Search ..... 292/336.3, 347, 292/348, 353, DIG. 31

(56) References Cited

U.S. PATENT DOCUMENTS 4,838,590 A * 6/1989 Isomura ..... 292/336.3
4,993,763 A * 2/1991 Tanimoto et al. ..... 292/336.3
5,005,885 A * 4/1991 Kobayashi et al. ..... 292/336.3
5,011,202 A 4/1991 Kato et al.
5,535,553 A 7/1996 Staser et al.
5,794,994 A * 8/1998 Miyagawa et al. ..... 292/336.3
5,895,081 A * 4/1999 Tanimoto et al. ..... 292/348
6,036,244 A 3/2000 Tyves et al.
6,406,075 B1 6/2002 Rice et al.
6,539,670 B2 4/2003 Haag et al.

* cited by examiner

*Primary Examiner*—Gary Estremsky
(74) *Attorney, Agent, or Firm*—Scott A. McBain

(57) ABSTRACT

A vehicle door handle assembly is mounted on a support panel for operating a door latch. The door handle assembly has a D-shaped door handle that includes an integral pivot pin. A lock button has a part cylindrical socket that receives the pivot pin to mount the lock button pivotally on the door handle. The pivot pin is shaped to provide a cross section that has a minimum thickness to facilitate lateral insertion of the pivot pin into the part cylindrical socket via a loading slot. The door handle also includes integral trunnions for mounting the door handle pivotally on the support panel.

13 Claims, 4 Drawing Sheets

VEHICLE DOOR HANDLE ASSEMBLY

This invention relates generally to a vehicle door handle assembly and more particularly to a vehicle door handle assembly that includes a door handle and a lock button for operating a vehicle door latch from inside the vehicle.

BACKGROUND OF THE INVENTION

U.S. Pat. No. 4,838,590 granted to Yukio Isomura Jun. 13, 1989 discloses an inside handle device that comprises a bezel that acts as a bracket, a D-shaped handle pivotally mounted on the bezel, and a lock button disposed inside the D-shaped handle, and pivotally mounted on the D-shaped handle at one end. The inside handle device also includes a separate hinge pin or pins for pivotally mounting the handle and the lock button for pivotal movement about the same axis. The handle is connected to a latch mechanism of a door latch (not shown) by a control rod. The lock button is connected to a lock mechanism of the door latch by a second control rod. A coil spring biases the door handle to the latched position.

U.S. Pat. No. 5,011,202 granted to Yuichi Kato and Masazumi Miyagawa Apr. 30, 1991 discloses a similar arrangement. The handle devices disclosed in these two patents provide the advantage of a D-shaped handle for unlatching a vehicle door that is strong and easy to operate while also providing a lock button for locking the vehicle door. However, the handle devices comprise many parts and are difficult to assemble.

SUMMARY OF THE INVENTION

This invention provides a vehicle door handle assembly that may have the advantages of a D-shaped door handle and a lock button that is easy to assemble, particularly with respect to assembly of the lock button to the door handle. The door handle has a pivot pin for pivotally mounting the lock button on the door handle. The pivot pin is shaped to facilitate lateral insertion of the pivot pin into a socket of the lock button via a loading slot. The pivot pin is turned when fully inserted into the socket and captured in the socket by positioning the loading slot outside the range of operational movement of the door handle and the lock button.

The pivot pin is preferably an integral part of the door handle. The door handle also preferably has trunnions for pivotally mounting the door handle on a support panel. The trunnions are also preferably an integral part of the door handle.

Thus it is possible for the door handle assembly to consist simply of a door handle, adapted for connection to a support panel, a lock button and a spring.

These and other objects, features and advantages of the invention will become apparent from the description below, which is given by way of example with reference to the accompanying drawings.

DESCRIPTION OF THE PREFERRED EMBODIMENT

Figure 1:
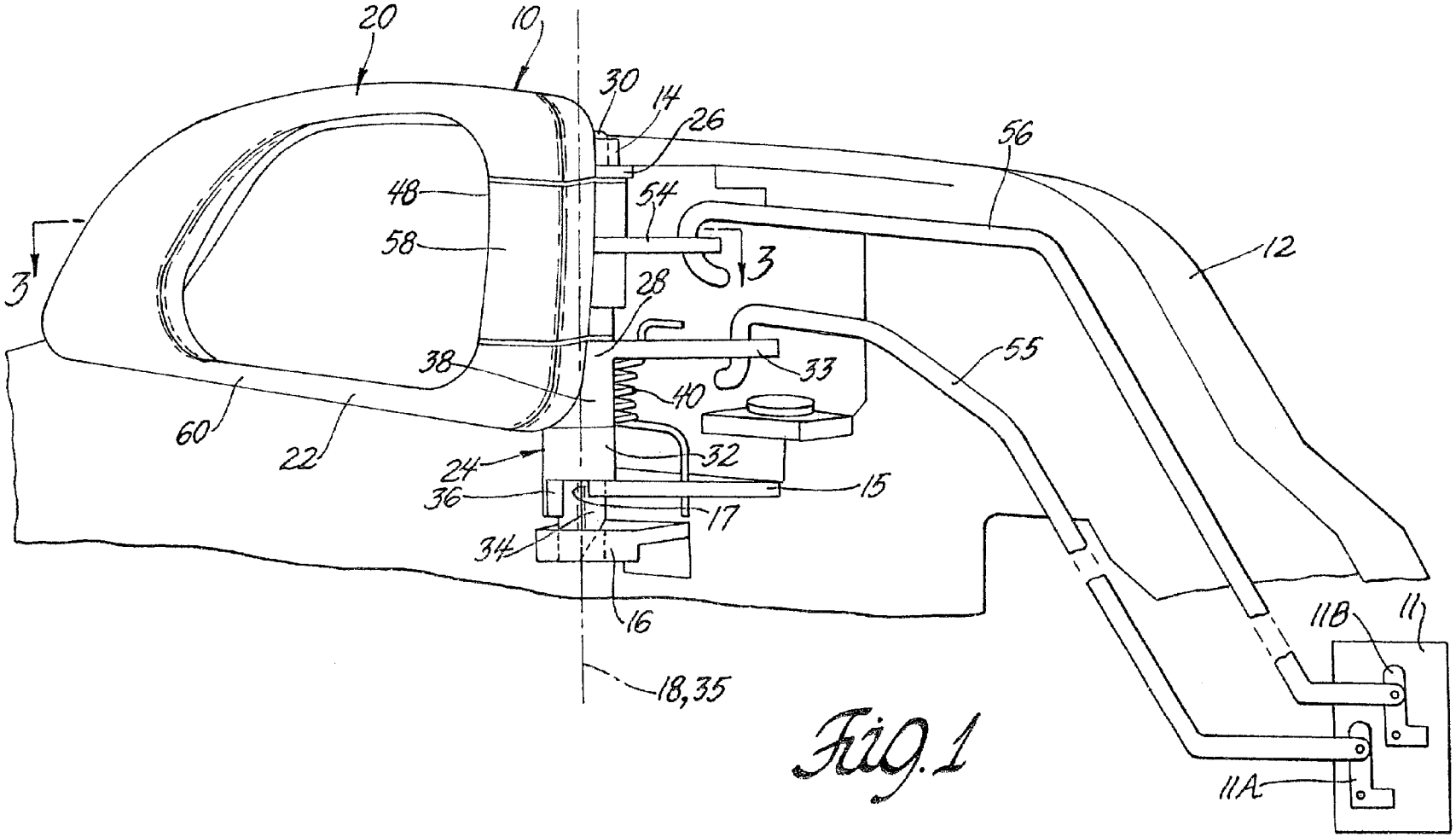
FIG. 1 is a front view of the door handle assembly of the invention installed on a support panel.
Figure 2:
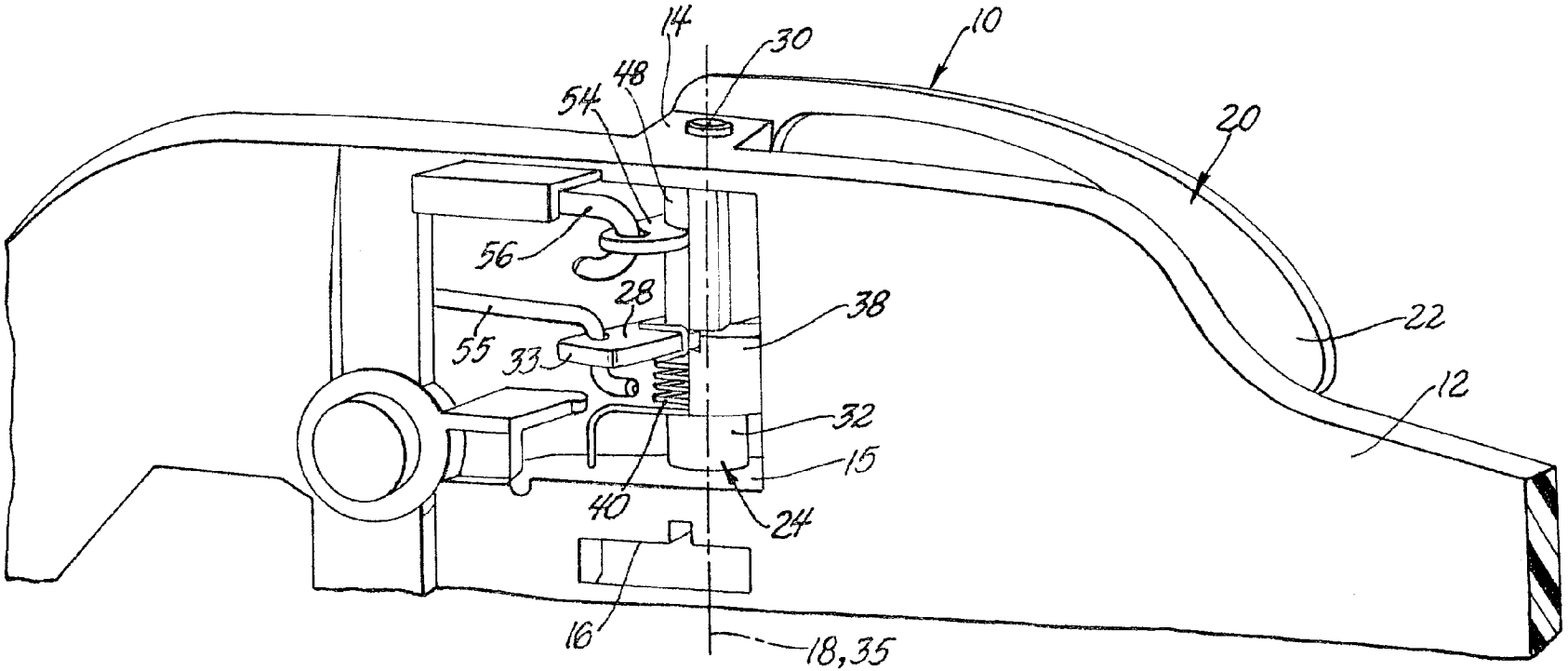
FIG. 2 is a rear view of the door handle assembly and support panel shown in FIG. 1.

Referring now to FIGS. 1 and 2, a door handle assembly 10 for operating a vehicle door latch (which shown schematically at 11 in FIG. 1) is mounted on a support panel 12 by three tabs—an upper tab 14 and two lower tabs 15 and 16 that are an integral part of the support panel 12. Upper tab 14 has a hole and lower tab 15 has a concentric hole with a snap-in slot 17 at the front end of the lower tab 15. Tab 16 which is below tab 15 has an elongated slot that is closed at the front end of tab 16. The holes in upper tab 14 and lower tab 15 establish a pivot axis 18 for the door handle assembly 10. This three tab arrangement which facilitates mounting of door handle assembly 10 on support panel 12 is known from U.S. Pat. No. 5,535,553 granted Jul. 16, 1996.

Figure 7:
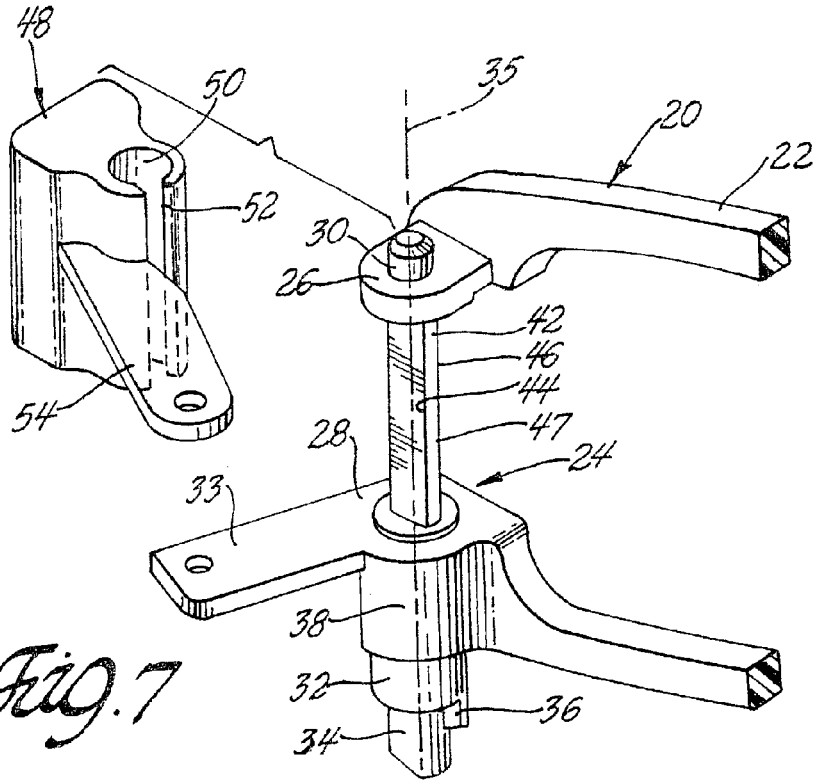
FIG. 7 is a partial exploded perspective view of the door handle assembly of FIG. 1 showing the door handle and the lock button in an assembly position.

Door handle assembly 10 includes a D-shaped door handle 20 that is preferably of molded one-piece construction as best shown in FIG. 7. Handle 20 has a flat C-shaped lever 22 attached to an offset mounting structure 24 by upper and lower lateral tabs 26 and 28 at the open end of the C-shaped lever 22 as best seen in FIG. 7. An upper trunnion 30 extends upwardly from upper lateral tab 26. A boss 32 extends downwardly from lower lateral tab 28 and a lower trunnion 34 extends downwardly from boss 32. Lower tab 28 is elongate to provide a lever 33 for operating door latch 11 as explained below.

Upper trunnion 30, boss 32 and lower trunnion 34 are concentric about an axis 35 that coincides with pivot axis 18 when the door handle assembly 10 is attached to support panel 12. Lower trunnion 34 includes a lateral stop tab 36 that cooperates with slot 17 at the front end of tab 15 to limit the pivotal movement of the D-shaped handle 20 with respect to the support panel 12. See FIGS. 1 and 7.

Door handle 20 is pivotally mounted on support panel 12 by inserting upper trunnion 30 through the hole in upper tab 14 and then swinging the mounting structure 24 toward support panel 12 until lower trunnion 34 snaps through slot 17 and into the hole in lower tab 15. Handle axis 35 now coincides with pivot axis 18 with handle 20 being pivotally attached to support panel 12 for pivotal movement between a latched position shown in FIGS. 1, 2, 3 and 5 and an unlatched position shown in FIGS. 4 and 6.

Boss 32 is spaced inside a C-shaped shroud that provides a partial cover 38 for a coil spring 40 that surrounds the upper portion of boss 32. Cover 38 hides coil spring 40 when viewed from inside the vehicle. Coil spring 40 engages lower tab 28 of handle 20 at one end and lower tab 15 of support panel 12 at the opposite end and biases door handle 20 to the latched position shown in FIGS. 1, 2, 3 and 5.

The mounting structure 24 of the D-shaped door handle 20 includes a concentric integral pivot pin 42 that extends between upper and lower tabs 26 and 28. Pivot pin 42 is non-circular in cross section preferably having two flat parallel surfaces 44 and 46 that are equidistant from axis 35 so that the pivot pin 42 is like a flat rectangular board of a given thickness with round edges 47 along the longer sides of the rectangle.

Door handle assembly 10 includes a lock button 48 that has a part cylindrical socket 50, an open ended loading slot 52 that leads into the part cylindrical socket 50 and a lever 54 as best shown in FIG. 7. The height of lock button 48 is slightly less than the height of pivot pin 42 and the width of loading slot 52 is slightly greater than the thickness of pivot pin 42. Lock button 48 is attached to the pivot pin 42 of door handle 20 by engaging slot 52 on pivot pin 42 across its thickness, pushing the lock button 48 onto pivot pin 42 until pivot pin 42 bottoms in socket 50 and then turning lock button 48 so that the round edges 47 of pivot pin 42 engage portions of socket 50 on opposite sides of slot 52. Lock button 48 is now located axially with respect to the door handle 20 in the direction of the axis 35 and also pivotally attached to door handle 20 for pivotal movement about axis 35. The pivotal movement of lock button 48 with respect to door handle 20 is limited as explained below.

Lock button 48 may be pivotally attached to door handle 20 either before or after door handle 20 is pivotally attached to support panel 12. In either event, once the lock button 48 is pivotally attached to door handle 20, lock button 48 it is held in a position where the thickness of pivot pin 42 does not align with slot 52.

When lock button 48 is pivotally attached to door handle 20 and door handle 20 is pivotally attached to support panel 12, door handle 20 and lock button 28 are connected to door latch 11 via control rods 55 and 56. Control rod 55 is connected to lever 33 of door handle 20 at one end and to an unlatching lever 11A of the door latch 11 at the other end so that door latch 11 is latched when door handle 20 is in the latched position shown in FIGS. 1, 2, 3 and 5 and door latch 11 is unlatched when door handle is pivoted to the unlatched position shown in FIGS. 4 and 6. As indicated above, door handle 20 is biased to the latched position by coil spring 40 while stop tab 36 cooperates with slot 37 to limit the pivotal movement of the door handle 20 back and forth between the latched position of FIGS. 1, 2, 3 and 5 and the unlatched position of FIGS. 4 and 6.

Figure 3:
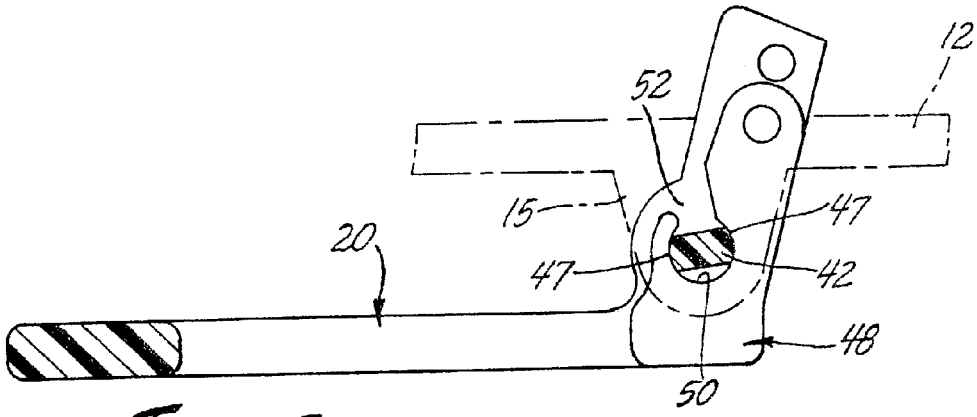
FIG. 3 is a section taken substantially along the line 3—3 of FIG. 1 looking in the direction of the arrows and showing the door handle in the latched position and the lock button in the unlocked position.
Figure 4:
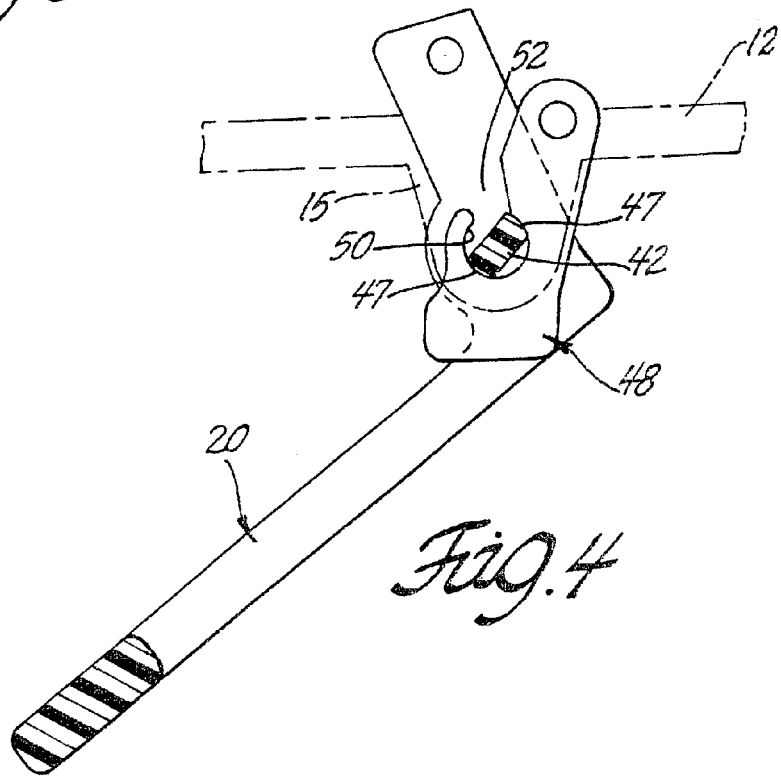
FIG. 4 is a section similar to FIG. 3 showing the door handle in the unlatched position and the lock button in the unlocked position.
Figure 5:
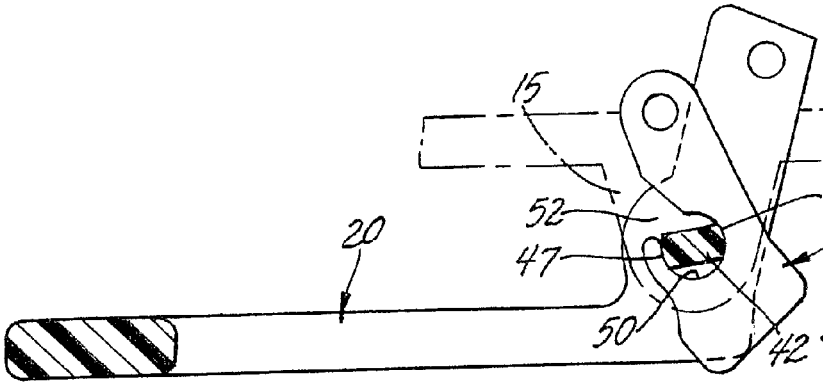
FIG. 5 is a section similar to FIG. 3 showing the door handle in the latched position and the lock button in the locked position.
Figure 6:
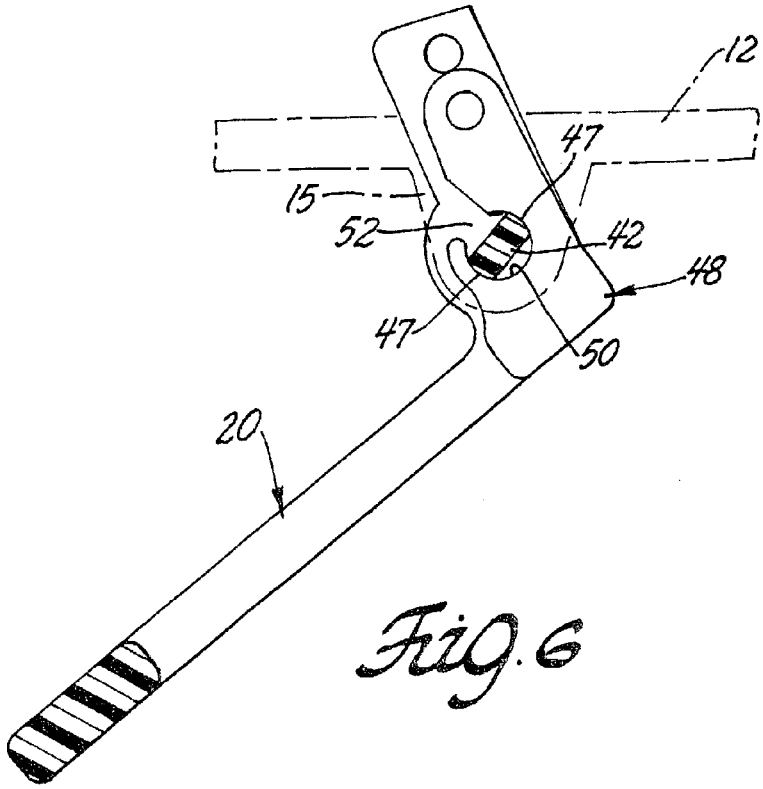
FIG. 6 is a section similar to FIG. 3 showing the door handle in the unlatched position and the lock button in the locked position.

Control rod 56 is attached to lever 54 of lock button 48 at one end and to a lock lever 11B of the door latch at the other end so that the door latch is locked when the lock button 48 is in the locked position shown in FIGS. 1, 2, 3 and 4 and the door latch is unlocked when lock button 48 is in the unlocked position shown in FIGS. 5 and 6. Lock button 48 is conventionally spring biased to either the locked or unlocked position via control rod 56 by spring biasing lock lever 11B of door latch 11 to either the locked or unlocked position while the pivotal movement of the lock button 48 is conventionally limited via control rod 56 to back and forth movement between the unlocked and locked positions by limiting back and forth movement of the lock lever of the door latch between the unlocked and locked positions by conformations of door latch 11 (not shown).

Once the door handle 20 and the lock button 48 are attached to the door latch by control rods 55 and 56, the pivot pin 42 of the door handle 20 is captured in the part cylindrical socket 50 of the lock button 48 in all operating positions of the door handle 20 and the lock button 48 as demonstrated in FIGS. 3, 4, 5 and 6 which show the various end positions of the door handle 20 and the lock button 48.

More specifically, FIG. 3 shows the door handle 20 in the latched position and the lock button 48 in the locked position corresponding to a latched and locked vehicle door. Under these conditions, the exterior surface 58 of the lock button 48 is preferably flush with the exterior surface 60 of the C-shaped door handle lever 22 as best shown in FIG. 1.

FIG. 4 shows the door handle 20 pivoted to the unlatched position while the lock button 48 is still in the locked position. This is one extreme position of the pivot pin 42 with respect to the slot 52 illustrating that the pivot pin 42 is still captured in socket 50.

FIG. 5 shows the lock button 48 moved to the unlocked position while the door handle 20 is still in the latched position. This is the other extreme position of the pivot pin 42 with respect to the slot 52 illustrating that the pivot pin 42 is still captured in socket 50.

FIG. 6 shows the lock button 48 moved to the unlocked position and the door handle 20 moved to the unlatched position which is possible when a door latch having a by-pass or free wheel type of locking mechanism is used. This condition produces an intermediate position of the pivot pin 42 with respect to the slot 52 illustrating that the pivot pin 42 is still captured in socket 50.

Slot 52 is also positioned so that it is not visible in any operating position of the door handle 20 or the lock button 48 as can be seen in FIGS. 3, 4, 5 and 6.

Thus the invention provides a vehicle door handle assembly that has a D-shaped door handle and a lock button that has few parts and that is easy to assemble.

While, the preferred embodiment of invention has the advantages of a D-shaped door handle and a lock button, other shapes of the door handle are also possible even though some advantage may be lost. In other words, many modifications and variations of the present invention in light of the above teachings may be made. It is, therefore, to be understood that, within the scope of the appended claims, the invention may be practiced otherwise than as specifically described.

We claim:

1. A door handle assembly for mounting on a support panel for operating a vehicle door latch comprising:

a door handle (20) having a pivot pin (24, 25) having an axis and a lock button (30) having a part cylindrical socket (34A) that is pivotally mounted on the pivot pin so that the lock button pivots about the axis with respect to the door handle back and forth between an unlocked position and a locked position, the lock button having a loading slot (34B) leading to the part cylindrical socket, the pivot pin being insertable laterally into the part cylindrical socket via the loading slot and non-removably captured in the part cylindrical socket of the lock button at the unlocked position and at the locked position and as the lock button pivots with respect to the door handle back and forth between the unlocked position and the locked position, the pivot pin being captured in the part cylindrical socket of the lock button by structure consisting of the respective shapes of the pivot pin, the part cylindrical socket and the loading slot.

2. A door handle assembly for mounting on a support panel for operating a vehicle door latch comprising:

a door handle having a pivot pin having an axis and a lock button having a part cylindrical socket that is pivotally mounted on the pivot pin so that the lock button pivots about the axis with respect to the door handle back and forth between an unlocked position and a locked position, the lock button having a loading slot leading to the part cylindrical socket, the pivot pin being insertable laterally into the part cylindrical socket via the loading slot and captured in the part cylindrical socket of the lock button at the unlocked position and at the locked position and as the lock button pivots with respect to the door handle back and forth between the unlocked position and the locked position, wherein the door handle is D-shaped comprising a C-shaped handle having first and second spaced ends and the pivot pin is a part of the door handle that extends from the first end to the second end of the handle.

3. The door handle assembly as defined in claim 2 wherein the pivot pin is an integral part of the door handle.

4. The door handle assembly as defined in claim 2 wherein the C-shaped handle has a mounting structure at one end, and wherein the pivot pin is an integral part of the mounting structure.

5. The door handle assembly as defined in claim 4 wherein the mounting structure of the door handle has integral upper and lower trunnions at the respective first and second spaced ends for pivotally attaching the door handle to the support panel.

6. The door handle assembly as defined in claim 5 further including a spring biasing the door handle to its latched position, the spring being partially covered by a cover that is an integral part of the mounting structure.

7. The door handle assembly as defined in claim 6 wherein the mounting structure of the door handle includes a stop tab for limiting movement of the door handle between a latched position and an unlatched position.

8. A door handle assembly for mounting on a support panel for operating a vehicle door latch comprising:

a door handle having a pivot pin having an axis and a lock button having a part cylindrical socket that is pivotally mounted on the pivot pin so that the lock button pivots about the axis with respect to the door handle back and forth between an unlocked position and a locked position, the lock button having a loading slot leading to the part cylindrical socket, the pivot pin being insertable laterally into the part cylindrical socket via the loading slot and captured in the part cylindrical socket of the lock button at the unlocked position and at the locked position and as the lock button pivots with respect to the door handle back and forth between the unlocked position and the locked position, wherein the pivot pin extends between an upper tab and a lower tab to define a height of the pivot pin and wherein the part cylindrical socket of the lock tab has a height that is slightly less than the height of the pivot pin so that the lock button pivots freely on the axis, while being located with respect to the door handle in the direction of the axis.

9. The door handle assembly as defined in claim 8 wherein the pivot pin has a cross section that is noncircular to provide a minimum thickness that facilitates insertion of the pivot pin into the part cylindrical socket via the loading slot.

10. The door handle assembly as defined in claim 8 wherein the pivot pin is rectangular and has flat parallel surfaces that are equidistant from the axis to provide a minimum thickness that facilitates insertion of the pivot pin into the part cylindrical socket via the loading slot, and wherein the pivot pin has round edges engaging the part cylindrical socket.

11. A door handle assembly for mounting on a support panel for operating a vehicle door latch comprising:

a door handle having a pivot pin having an axis and a lock button having a socket that is pivotally mounted on the pivot pin so that the lock button pivots about the axis with respect to the door handle back and forth between an unlocked position and a locked position, the lock button having a loading slot leading into the socket, the pivot pin being insertable laterally into the socket via the loading slot and non-removably captured in the socket of the lock button at the unlocked position and at the locked position and as the lock button pivots with respect to the door handle back and forth between the unlocked position and the locked position, the pivot pin being captured in the socket of the lock button by structure consisting of engaging portions of the socket adjacent opposite sides of the loading slot engaging portions of the pivot pin.

12. The door handle assembly as defined in claim 11 wherein the pivot pin is captured in the socket of the lock button by the respective shapes of the pivot pin, the socket and the loading slot.

13. A door handle assembly for mounting on a support panel for operating a vehicle door latch comprising:

a door handle having a pivot pin having an axis and a lock button having a socket that is pivotally mounted on the pivot pin so that the lock button pivots about the axis with respect to the door handle back and forth between an unlocked position and a locked position, the lock button having a loading slot leading into the socket, the pivot pin being insertable laterally into the socket via the loading slot and captured in the socket of the lock button at the unlocked position and at the locked position and as the lock button pivots with respect to the door handle back and forth between the unlocked position and the locked position, the pivot pin being captured in the socket of the lock button by engaging portions of the socket adjacent opposite sides of the loading slot, wherein the socket is part cylindrical and has a diameter, wherein the slot has a width that is less than the diameter of the socket, wherein the pivot pin has a thickness that fits through the slot, and wherein the thickness of the pivot pin does not align with the slot when the pivot pin is captured in the socket.

* * * * *